US006682324B2

(12) United States Patent
Hodapp et al.

(10) Patent No.: US 6,682,324 B2
(45) Date of Patent: Jan. 27, 2004

(54) RADIAL TURBO-BLOWER

(75) Inventors: Josef Hodapp, Euskirchen (DE); Karl-Heinz Ronthaler, Zuelpich (DE); Hans Kriechel, Bonn (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/182,107

(22) PCT Filed: Jan. 24, 2001

(86) PCT No.: PCT/EP01/00758

§ 371 (c)(1),
(2), (4) Date: Oct. 1, 2002

(87) PCT Pub. No.: WO01/55598

PCT Pub. Date: Aug. 2, 2001

(65) Prior Publication Data

US 2003/0118461 A1 Jun. 26, 2003

(30) Foreign Application Priority Data

Jan. 26, 2000 (DE) ..... 100 03 153

(51) Int. Cl.[7] ..... F04B 35/04

(52) U.S. Cl. ..... 417/423.1; 417/423.8; 417/423.13

(58) Field of Search ..... 417/423.7, 423.8, 417/423.11, 423.12, 423.13

(56) References Cited

U.S. PATENT DOCUMENTS

| | | | | |
|---|---|---|---|---|
| 2,693,149 A | * | 11/1954 | White | 417/357 |
| 5,332,374 A | * | 7/1994 | Kricker et al. | 417/420 |
| 5,951,267 A | * | 9/1999 | Piercey et al. | 417/423.11 |
| 6,312,234 B1 | * | 11/2001 | Okada | 417/423.4 |

FOREIGN PATENT DOCUMENTS

| | | |
|---|---|---|
| EP | 0 411 134 | 2/1991 |
| EP | 0 412 165 | 2/1991 |
| WO | WO 98/02652 | 1/1998 |
| WO | WO 99/08363 | 2/1999 |

* cited by examiner

*Primary Examiner*—Charles G. Freay
(74) *Attorney, Agent, or Firm*—Fay, Sharpe, Fagan, Minnich & McKee, LLP

(57) ABSTRACT

The radial turbo-blower comprises a stator (35) that is housed in a stator housing (10) and a rotor (13) that rotates within a pump housing (11). The rotor (13) comprises a cavity (23) with a bearing arrangement (26) that is received by a protruding bearing pin (25). A pump chamber (12) is separated from a stator chamber (22) by a thin partition wall (21). Thereby, an atmospheric pressure is maintained in the stator chamber (22). The blower consists of few components and has a short structural length. It is substantially maintenance-free and the rotor area is protected from being contaminated by oil.

13 Claims, 1 Drawing Sheet

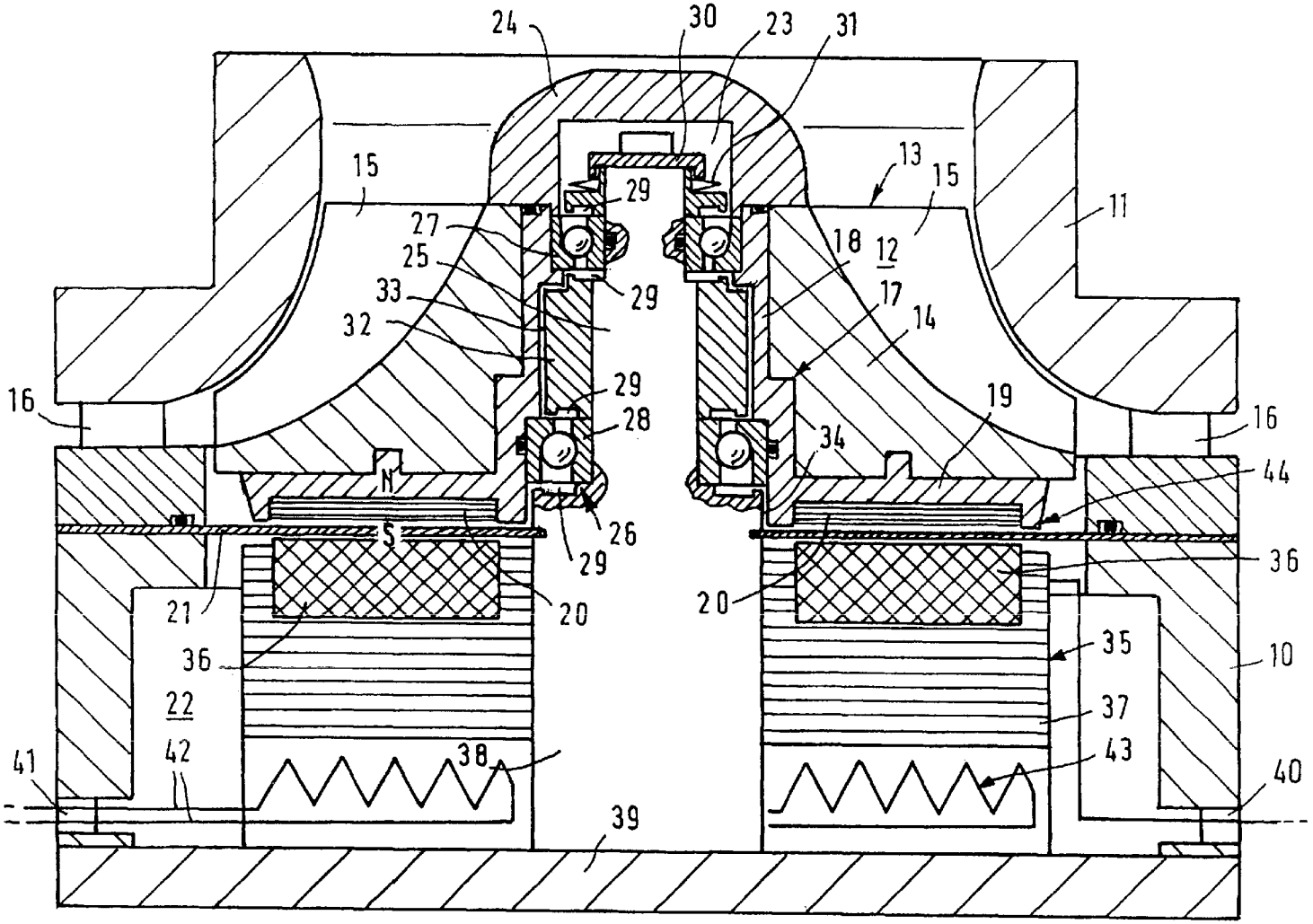
11
16
44
36
10
40
35
37
43
19
15
13
14
12
17
18
34
31
23
30
20
29
28
26
39
24
27
25
33
32
N
S
38
21
22
42
41

RADIAL TURBO-BLOWER

BACKGROUND OF THE INVENTION

The invention relates to a radial turbo-blower comprising a rotatably supported rotor and a motor driving the rotor.

Conventionally, radial turbo-blowers of both the single-stage and the two-stage type in vacuum technology are constructed such that rotor, motor and bearing are arranged one behind the other, the rotor being adapted to be located between the bearings or to be cantilevered. The bearings are lubricated by oil delivered to the bearings by an oil delivery means. Such radial turbo-blowers have a great axial structural length and a great number of components. They require complicated balancing processes. Further, there is the danger of contaminating the rotor region with the oil provided to lubricate the bearings. The motor is located in the vacuum, which requires a complicated insulation of the windings with the result of bad heat transmissions and a sealed line leadthrough for the power lines.

SUMMARY OF THE INVENTION

It is the object of the present invention to provide a radial turbo-blower having a compact structure and being able to be produced from few components at low costs.

This object is solved, according to the invention, with the features indicated in claim 1. Accordingly, the motor is a permanently excited disk armature motor comprising permanent magnets with axial magnetic field orientation which are mounted to the rotor, and stationary stator windings. Thus, the motor is partially integrated in the rotor and arranged in immediate proximity to the rotor. Thereby, the structural length of the blower is reduced. Further, by a bearing arrangement housed in a cavity of the rotor, the rotor is supported on a stationary bearing pin projecting into the cavity. Thus, the rotor is exclusively supported in the interior of the rotor, a shaft rotating therewith not being required. The rotor hub can rather be directly supported on the bearing arrangement seated on the bearing pin. By this kind of supporting, vibrations of the rotor are also avoided. This results in low rotor losses and thereby, the efficiency is increased. The stationary bearing pin facilitates the production. For the motor, a simple water cooling can be installed.

Preferably, the bearing arrangement is lubricated with grease, at least one grease chamber being provided in the cavity of the rotor. As an alternative, it is possible to use magnetic bearings which are maintenance-free as well. A combination of magnetic bearing and grease-lubricated bearing is conceivable as well.

Preferably, the cavity of the rotor is open to the rear and at the rear end of the cavity, a sealing gap is formed between the rotor and the bearing pin. This sealing gap prevents that lubrication grease and bearing components are sucked from the cavity into the pump chamber. It is also possible to use a sealing there, but in this case, parts rubbed off the sealing may enter the pump chamber.

According to a preferred embodiment of the invention, a narrow heat transmission gap having a width of not more than 0.5 mm for carrying heat away from the rotor to the bearing pin is formed between the wall defining the cavity and a spacer ring seated on the bearing pin in a well heat-conducting manner. Due to the formation of a narrow heat transmission gap, heat is carried away from the rotor to the cooled bearing pin.

A pressure-tight magnetically permeable partition wall can be arranged between the rotor and the stator windings. This partition wall may consist of a membrane, a fiber composite or a casting compound. It effects a vacuum sealing between the pump chamber and the motor chamber so that the stator contained in the motor chamber is positioned on the atmospheric side and not in a vacuum chamber. This permits a simpler and cheaper winding insulation of the stator windings. Moreover, no pressure-tight current leadthrough is required on the stator housing. It is rather possible to use a simple terminal box.

With the radial turbo-blower according to the invention, it is also possible to substantially simplify the cooling by housing a cooling device in the stator housing. This cooling device cools both the stator and the bearing pin and effects that heat transmitted from the rotor to the bearing pin is carried away.

When the rotational position of the rotor is to be detected, a corresponding transmitter on an inductive, capacitive or optical basis can be provided, said transmitter being arranged in the stator.

Another advantage of the construction of the motor as a disk armature motor according to the invention is that the stator coils attract the rotor so that it is not necessary to mechanically apply a biasing axial force on the rotor.

The radial turbo-blower is particularly suitable for high-speed blowers, e.g., for the use in high-flow speed $CO_2$ lasers.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

The FIGURE illustrates a turbo-blower in longitudinal cross-section.

DETAILED DESCRIPTION OF THE PREFERRED EMBODIMENTS

The radial turbo-blower comprises a stator housing 10 and a pump housing 11. The pump housing 11 includes a pump chamber 12 in which a rotatable rotor 13 comprising a hub 14 and vanes 15 projecting therefrom is arranged. The vanes 15 have outer edges following the contour of the wall of the pump housing 11, leaving a small gap. The pump axially takes in the fluid to be pumped and radially delivers it to the outlets 16.

The hub 14 of the rotor 13 includes a supporting member 17 consisting of a tube section 18 and a flange section 19. The flange section 19 forms the rear end wall of the rotor 13. It defines recesses in which permanent magnets 20 are arranged. These permanent magnets have an axial magnetic field orientation. This means that the north pole N and the south pole S lie on a line extending parallel to the rotor axis. The supporting member 17 and the hub 14 consist of non-magnetic material.

A partition wall 21 separating an interior chamber 22 of the stator housing 10 from the pump room 12 is provided adjacent to the permanent magnets 20. The partition wall 21 consists of a magnetically permeable membrane, preferably of fiber composite, or a compound casting. It effects a vacuum seal between the stator chamber 22 and the pump chamber 12.

The rotor 13 comprises an inner cavity 23 sealingly closed by a cap 24 at its front end. A bearing pin 25 on which the rotor 13 is supported by a bearing arrangement 26 protrudes into this cavity 23. This bearing arrangement includes two rolling bearings, i.e. a front ball bearing 27 and a rear ball bearing 28. These ball bearings are seated on the bearing pin 25 and they bear the tube section 18 of the supporting member 17. Adjacent to each ball bearing, at least one grease chamber 29 containing a pasty grease to lubricate the bearings is arranged. At least one of these bearings can also be configured as a magnetic bearing. In principle, it is also possible to configure the complete bearing as magnetic bearing.

On the outer end of the bearing pin 25, a cap 30 is mounted which supports a disk spring package 31 which, in turn, presses against the front ball bearing 27 and thus keeps the bearing arrangement axially compressed.

Between the ball bearings 27 and 28, a spacer ring 32 of a material with good heat conducting characteristics is located on the bearing pin 25 in close contact therewith. Between the wall of the tubular portion 18 defining the cavity 23 and the spacer ring 32, there is a heat transmission gap 33 having a width of not more than 0.5 mm, preferably of about 0.4 mm, for carrying the heat of the rotor 13 via the spacer ring 32 away to the bearing pin 25.

Between the rear end of the tube section 18 of the supporting member 17 and the bearing pin 25, a sealing gap 34 is formed. This sealing gap permits gas to be sucked from the pump chamber 12 into the cavity 23. From the cavity, it is carried away through a bore (not illustrated) in the bearing pin 25. The sealing gap 34 represents the only opening of the cavity 23.

The stator 35 with the stator coils 36 set in an iron package 37 is located in the stator chamber 22. Together with the supporting member 17 containing the permanent magnets 20, the stator 35 forms the disk armature motor 44. The stator coils 36 lie on the same circle on which the permanent magnets 20 move when the rotor 13 rotates. In a cyclically rotating manner, an electronic commutator generates electric current in the stator windings 36 so that the stator windings generate a rotating magnetic field. With its permanent magnets 20, the rotor 13 follows this magnetic field. Virtually, the disk armature motor is a magnetic coupling for the contactless rotor drive. In the air gap between the stator coils 36 and the permanent magnets 20, there is the partition wall 21. This partition wall is sealingly mounted to a base 38 which is fixed to a bottom wall 39 of the stator housing 10 and forms part of the bearing pin 25. Since the partition wall 21 separates the stator chamber 22 from the vacuum part, the stator chamber 22 is at atmospheric pressure. There is a cable opening 40 in the wall of the stator housing 10 for leading through power cables. Further, a pipe passage opening 41 is provided through which pipelines 42 pass which are part of a cooling spiral flown through by cooling water, said cooling spiral forming the cooling device 43. The cooling device 43 cools the stator 35 as well as the bearing pin 25 and carries away the heat from the entire blower housing.

The radial turbo-blower consists of few components and can be produced at low costs. It is largely maintenance-free.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A radial turbo-blower comprising:

a rotatably supported rotor;

a permanently excited disk armature motor including:

permanent magnets with an axial magnetic field orientation mounted to the rotor, and stationary stator coils; and a bearing arrangement housed in a cavity of the rotor to support the rotor on a stationary bearing pin projecting into the cavity, the cavity of the rotor open only to the rear; and a sealing gap formed between the rotor and the bearing pin at the rear end of the cavity.

2. The radial turbo-blower according to claim 1, wherein the bearing arrangement comprises:

a grease lubrication with at least one grease chamber.

3. The radial turbo-blower according to claim 1, further including:

a narrow heat transmission gap having a width of not more than 0.5 mm for carrying away heat from the rotor to the bearing pin formed between a wall defining the cavity and a spacer ring seated on the bearing pin in a beat-conducting relationship.

4. The radial turbo-blower according to claim 1, further including:

a pressure-tight magnetically permeable partition wall arranged between the rotor and the stator coils.

5. The radial turbo-blower according to claim 4, wherein the stator coils are contained in a stator housing under atmospheric pressure which contains a cooling device.

6. The radial turbo-blower according to claim 1, the bearing arrangement includes:

a grease-lubricated bearing, and a passive magnetic bearing.

7. The radial turbo-blower according to claim 1, the bearing arrangement includes active magnetic bearings.

8. The radial turbo-blower according to claim 6, wherein the grease lubricated bearing is mounted above and displaced from the passive magnetic bearing.

9. A radial turbo-blower comprising:

a rotatably supported rotor; and a permanently excited disk armature motor including:

permanent magnets with an axial magnetic field orientation mounted to the rotor, and stationary stator coils contained in a stator housing which contains a cooling device; and a bearing arrangement housed in a cavity of the rotor to support the rotor on a stationary bearing pin projecting into the cavity, a portion of the bearing pin being disposed in heat-conducting contact with a stator and protruding therefrom and being thermally connected with the cooling device.

10. The radial turbo-blower according to claim 9 wherein the cavity of the rotor is open only to the rear and further including:

a sealing gap formed between the rotor and the bearing pin at the rear end of the cavity.

11. The radial turbo-blower according to claim 9, further including:

a pressure-tight magnetically permeable partition wall arranged between the rotor and the stator coils.

12. The radial turbo-blower according to claim 9, the bearing arrangement includes:

a grease-lubricated bearing, and a passive magnetic bearing.

13. The radial turbo-blower according to claim 9, the bearing arrangement includes active magnetic bearings.

* * * * *